US010553971B1

(12) United States Patent
Phillips et al.

(10) Patent No.: US 10,553,971 B1
(45) Date of Patent: Feb. 4, 2020

(54) CARD EDGE CONNECTOR HAVING A CONTACT POSITIONER

(71) Applicant: TE CONNECTIVITY CORPORATION, Berwyn, PA (US)

(72) Inventors: Michael John Phillips, Camp Hill, PA (US); Michael Eugene Shirk, Grantville, PA (US); Randall Robert Henry, Lebanon, PA (US)

(73) Assignee: TE CONNECTIVITY CORPORATION, Berwyn, PA (US)

( * ) Notice: Subject to any disclaimer, the term of this patent is extended or adjusted under 35 U.S.C. 154(b) by 0 days.

(21) Appl. No.: 16/242,457

(22) Filed: Jan. 8, 2019

(51) Int. Cl.

| | |
|---|---|
| ***H01R 12/72*** | (2011.01) |
| ***H01R 12/71*** | (2011.01) |
| ***H01R 13/6587*** | (2011.01) |
| ***H01R 13/66*** | (2006.01) |
| ***H01R 24/00*** | (2011.01) |
| ***H01R 12/57*** | (2011.01) |
| ***H01R 13/6594*** | (2011.01) |
| ***H01R 107/00*** | (2006.01) |

(52) U.S. Cl.
CPC ..... *H01R 12/721* (2013.01); *H01R 12/57* (2013.01); *H01R 12/716* (2013.01); *H01R 13/6587* (2013.01); *H01R 13/6594* (2013.01); *H01R 13/6658* (2013.01); *H01R 24/00* (2013.01); *H01R 2107/00* (2013.01)

(58) Field of Classification Search
CPC ..... H01R 23/7068; H01R 13/432; H01R 13/6587; H01R 13/6658; H01R 13/6594; H01R 12/721; H01R 12/716; H01R 12/57; H01R 24/00; H01R 2107/00
USPC ..... 439/637, 636
See application file for complete search history.

(56) References Cited

U.S. PATENT DOCUMENTS

| | | | | |
|---|---|---|---|---|
| 3,671,917 A * | 6/1972 | Ammon | H01R 12/721 | 439/62 |
| 3,737,838 A * | 6/1973 | Mattingly, Jr. | H01R 12/585 | 439/634 |
| 4,303,294 A * | 12/1981 | Hamsher, Jr. | H01R 12/88 | 439/267 |
| 4,660,920 A * | 4/1987 | Shibano | H01R 12/721 | 439/631 |
| 5,013,264 A * | 5/1991 | Tondreault | H01R 12/721 | 439/636 |
| 5,465,302 A | 11/1995 | Lazzari et al. | | |

(Continued)

OTHER PUBLICATIONS

U.S. Appl. No. 16/045,178, filed Jul. 25, 2018 (40 pages).

*Primary Examiner* — Gary F Paumen

(57) ABSTRACT

A card edge connector includes a contact assembly received in a cavity of a housing. The contact assembly has a contact positioner holding upper and lower contacts. The contact positioner has an upper wall with upper contact channels holding mating beams of the upper contacts and a lower wall with lower contact channels holding mating beams of the lower contacts. A positioner card slot is defined between the walls receiving a card edge of a module circuit board. The upper wall has pre-load beams in the upper contact channels engaging the mating beams of the upper contacts to pre-load the upper contacts in an inward biasing direction and the lower wall has pre-load beams in the lower contact channels engaging the mating beams of the lower contacts to pre-load the lower contacts in an inward biasing direction.

20 Claims, 7 Drawing Sheets

(56) References Cited

U.S. PATENT DOCUMENTS 5,478,259 A * 12/1995 Noschese ..... H01R 13/658 439/607.31
5,738,535 A * 4/1998 Cairns ..... G02B 6/3816 439/138
5,791,942 A * 8/1998 Patel ..... H01R 13/6461 439/60
5,830,017 A * 11/1998 Owsley ..... H01R 12/721 439/637
6,565,387 B2 5/2003 Cohen
7,074,064 B2 * 7/2006 Wallace ..... H01R 13/523 166/65.1
7,618,198 B2 * 11/2009 Baxter ..... G02B 6/3816 385/53
8,162,675 B2 4/2012 Regnier et al.
8,192,089 B2 * 6/2012 Cairns ..... G02B 6/3816 385/138
8,226,441 B2 7/2012 Regnier et al.
8,753,145 B2 6/2014 Lang et al.
8,858,237 B2 * 10/2014 Hsu ..... H01R 13/514 439/60
9,157,561 B2 * 10/2015 Martin ..... F16L 37/35
9,246,261 B2 * 1/2016 Hatcher ..... H01R 13/523
9,263,824 B2 * 2/2016 Cairns ..... H01R 24/38
9,270,051 B1 * 2/2016 Christiansen ..... H01R 13/523
9,590,350 B2 * 3/2017 Plant ..... H01R 13/523
9,742,104 B2 * 8/2017 Plant ..... G02B 6/4427
2001/0049206 A1 * 12/2001 Johnescu ..... H01R 13/2442 439/66
2005/0142948 A1 * 6/2005 Lee ..... H01R 12/725 439/630
2005/0221682 A1 * 10/2005 Stoner ..... H01R 13/193 439/689
2007/0117467 A1 * 5/2007 van der Steen ..... H01R 13/114 439/660
2015/0140866 A1 * 5/2015 Tsai ..... H01R 12/724 439/637

* cited by examiner

CARD EDGE CONNECTOR HAVING A CONTACT POSITIONER

BACKGROUND OF THE INVENTION

The subject matter herein relates generally to card edge connectors of communication systems.

Some communication systems utilize communication connectors, such as card edge connectors to interconnect various components of the system for data communication. Some known communication systems use pluggable modules, such as I/O modules, that are electrically connected to the card edge connectors. The pluggable modules have module circuit boards having card edges that are mated with the card edge connectors during the mating operation. Each card edge connector has an upper row of contacts and a lower row of contact for mating with the corresponding circuit board. The contacts are typically curved at the mating ends to provide a large lead-in for the circuit board during mating to prevent mechanical stubbing and damage to the contacts during mating. However, such extra lengths of contacts at the ends of the contacts beyond the mating interfaces of the contacts create electrical stubs that affect the electrical performance of the card edge connectors.

A need remains for a card edge connector having an improved mating interface greatly reducing electrical stubs of the contacts of the card edge connector.

BRIEF DESCRIPTION OF THE INVENTION

In one embodiment, a card edge connector is provided for mating with a pluggable module including a housing having a cavity, a housing card slot at a front of the housing and a chamber adjacent the housing card slot. The housing card slot is configured to receive a card edge of a module circuit board of the pluggable module. The card edge connector includes contact assembly received in the cavity. The contact assembly has a contact positioner holding upper contacts in an upper contact array and lower contacts in a lower contact array. The contact positioner has an upper wall with upper contact channels holding mating beams of the upper contacts and a lower wall with lower contact channels holding mating beams of the lower contacts. The upper wall is positioned relative to the lower wall with a positioner card slot defined therebetween configured to receive the card edge of the module circuit board. The mating beams of the upper contacts extend into the positioner card slot to mate with the module circuit board and the mating beams of the lower contacts extending into the positioner card slot to mate with the module circuit board. The upper wall has pre-load beams in the upper contact channels engaging the mating beams of the upper contacts to pre-load the upper contacts in a inward biasing direction and the lower wall has pre-load beams in the lower contact channels engaging the mating beams of the lower contacts to pre-load the lower contacts in an inward biasing direction.

In another embodiment, a card edge connector for mating with a pluggable module is provided including a housing having a cavity, a housing card slot at a front of the housing and a chamber adjacent the housing card slot. The housing card slot is configured to receive a card edge of a module circuit board of the pluggable module. The housing is configured to be mounted to a host circuit board. The card edge connector includes a contact assembly received in the cavity. The contact assembly includes upper contacts in an upper contact array with the upper contacts having mating beams and contact tails at opposite ends of the upper contacts. The mating beams are configured to be mated with the module circuit board and the contact tails are configured to be terminated to the host circuit board. The contact assembly includes lower contacts in a lower contact array with the lower contacts having mating beams and contact tails at opposite ends of the lower contacts. The mating beams are configured to be mated with the module circuit board and the contact tails are configured to be terminated to the host circuit board. The contact assembly includes a contact positioner holding the upper and lower contacts. The contact positioner has a base, arms extending from the base and a nose between the arms. The base has tail channels receiving corresponding contact tails of the upper and lower contacts to position the contact tails relative to each other. The nose has an upper wall with upper contact channels holding corresponding mating beams of the upper contacts and a lower wall with lower contact channels holding corresponding mating beams of the lower contacts. The upper and lower walls extend between the arms. The nose has a positioner card slot defined between the upper and lower walls configured to receive the card edge of the module circuit board. The upper wall has pre-load beams in the upper contact channels engaging the mating beams of the upper contacts to pre-load the upper contacts in a inward biasing direction and the lower wall has pre-load beams in the lower contact channels engaging the mating beams of the lower contacts to pre-load the lower contacts in an inward biasing direction.

In a further embodiment, a card edge connector for mating with a pluggable module is provided including a housing having a cavity, a housing card slot at a front of the housing and a chamber adjacent the housing card slot. The housing card slot is configured to receive a card edge of a module circuit board of the pluggable module. The card edge connector includes a contact assembly received in the cavity having a contact positioner holding upper contacts in an upper contact array and lower contacts in a lower contact array. The contact positioner has an upper wall with upper contact channels holding mating beams of the upper contacts and a lower wall with lower contact channels holding mating beams of the lower contacts. The upper wall has an upper wall surface and the lower wall having a lower wall surface facing the upper wall surface across a positioner card slot configured to receive the card edge of the module circuit board. The mating beams of the upper contacts each have an arm and a finger at a distal end of the arm extending to a tip. The finger is arranged in the positioner card slot for mating engagement with the module circuit board. The tip is located above the upper wall surface. The mating beams of the lower contacts each have an arm and a finger at a distal end of the arm extending to a tip. The finger is arranged in the positioner card slot for mating engagement with the module circuit board. The tip is located below the lower wall surface. The upper wall has pre-load beams in the upper contact channels engaging the mating beams of the upper contacts to pre-load the upper contacts in a inward biasing direction and the lower wall has pre-load beams in the lower contact channels engaging the mating beams of the lower contacts to pre-load the lower contacts in an inward biasing direction.

DETAILED DESCRIPTION OF THE INVENTION

Figure 1:
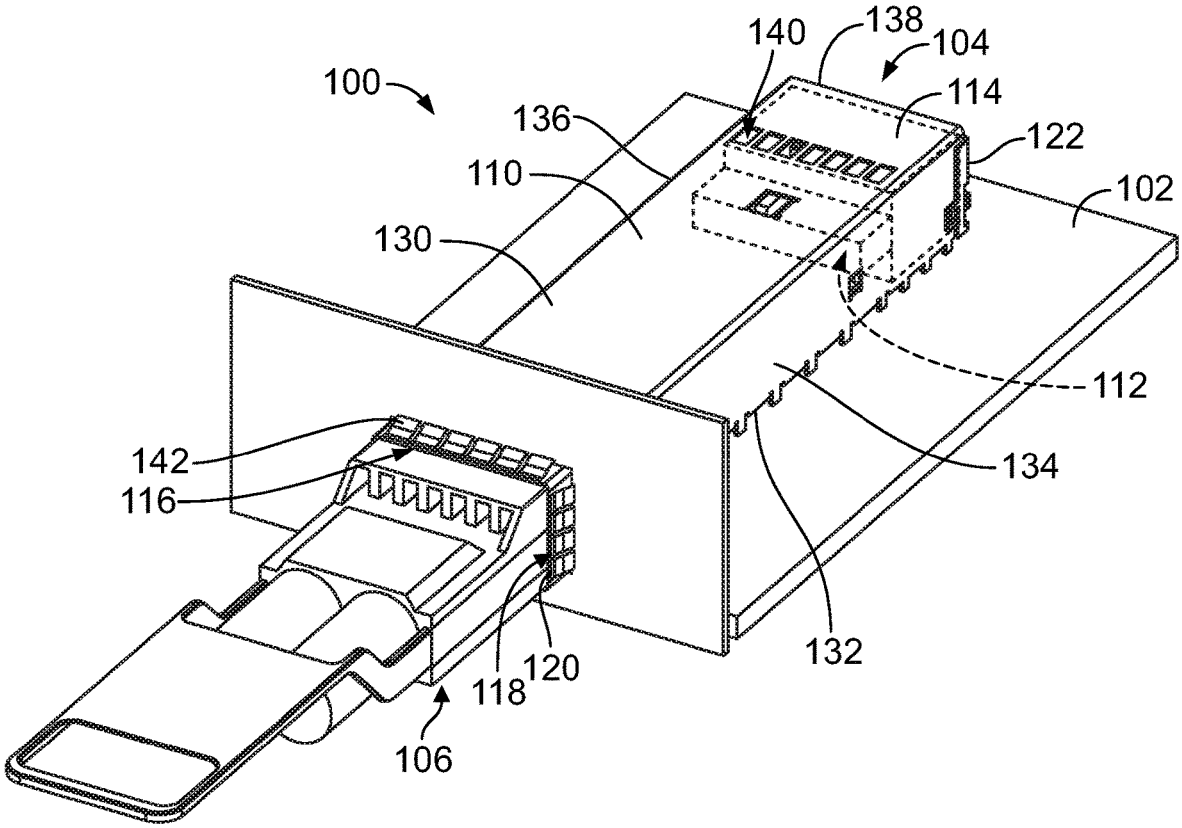
FIG. 1 is a front perspective view of a communication system formed in accordance with an exemplary embodiment.

FIG. 1 is a front perspective view of a communication system 100 formed in accordance with an exemplary embodiment. The communication system includes a host circuit board 102 and a receptacle connector assembly 104 mounted to the host circuit board 102. A pluggable module 106 (fully shown in FIG. 2) is configured to be electrically connected to the receptacle connector assembly 104. The pluggable module 106 is electrically connected to the host circuit board 102 through the receptacle connector assembly 104.

In an exemplary embodiment, the receptacle connector assembly 104 includes a receptacle cage 110 and a card edge connector 112 (shown with phantom lines) adjacent the receptacle cage 110. For example, in the illustrated embodiment, the card edge connector 112 is received in the receptacle cage 110. In other various embodiments, the card edge connector 112 may be located rearward of the receptacle cage 110. In various embodiments, the receptacle cage 110 is enclosed and provides electrical shielding for the card edge connector 112. The pluggable modules 106 are loaded into the receptacle cage 110 and are at least partially surrounded by the receptacle cage 110. In an exemplary embodiment, the receptacle cage 110 is a shielding, stamped and formed cage member that includes a plurality of shielding walls 114 that define one or more module channels for receipt of corresponding pluggable modules 106. In other embodiments, the receptacle cage 110 may be open between frame members to provide cooling airflow for the pluggable modules 106 with the frame members of the receptacle cage 110 defining guide tracks for guiding loading of the pluggable modules 106 into the receptacle cage 110. In other various embodiments, the receptacle connector assembly 104 may be provided without the receptacle cage 110, rather only including the card edge connector 112.

In the illustrated embodiment, the receptacle cage 110 is a single port receptacle cage configured to receive a single pluggable module 106. In other various embodiments, the receptacle cage 110 may be a ganged cage member having a plurality of ports ganged together in a single row and/or a stacked cage member having multiple ports stacked as an upper port and a lower port. The receptacle cage 110 includes a module channel 116 having a module port 118 open to the module channel 116. The module channel 116 receives the pluggable module 106 through the module port 118. In an exemplary embodiment, the receptacle cage 110 extends between a front end 120 and a rear end 122. The module port 118 is provided at the front end 120. Any number of module channels 116 may be provided in various embodiments arranged in a single column or in multiple columns (for example, 2×2, 3×2, 4×2, 4×3, 4×1, 2×1, and the like). Optionally, multiple card edge connectors 112 may be arranged within the receptacle cage 110, such as when multiple rows and/or columns of module channels 116 are provided.

In an exemplary embodiment, the walls 114 of the receptacle cage 110 include a top wall 130, a bottom wall 132, a first side wall 134 and a second side wall 136 extending from the top wall 130. The bottom wall 132 may rest on the host circuit board 102. In other various embodiments, the receptacle cage 110 may be provided without the bottom wall 132. Optionally, the walls 114 of the receptacle cage 110 may include a rear wall 138 at the rear end 122. The walls 114 define a cavity 140. For example, the cavity 140 may be defined by the top wall 130, the bottom wall 132, the side walls 134, 136 and the rear wall 138. The cavity 140 includes the module channel 116. In various embodiments, the cavity 140 receives the card edge connector 112, such as at the rear end 122. Other walls 114 may separate or divide the cavity 140 into additional module channels 116, such as in embodiments using ganged and/or stacked receptacle cages. For example, the walls 114 may include one or more vertical divider walls between ganged module channels 116. In various embodiments, the walls 114 may include a separator panel between stacked upper and lower module channels 116. The separator panel may include an upper panel and a lower panel that form a space between the upper and lower module channels 116, such as for airflow, for a heat sink, for routing light pipes, or for other purposes.

In an exemplary embodiment, the receptacle cage 110 may include one or more gaskets 142 at the front end 120 for providing electrical shielding for the module channels 116. For example, the gaskets 142 may be provided at the port 118 to electrically connect with the pluggable modules 106 received in the module channel 116. Optionally, the pluggable module 106 may include a gasket that engages the receptacle cage 110 rather than the receptacle cage 110 having a gasket that engages the pluggable module 106. In an exemplary embodiment, the gaskets 142 may be provided around the exterior of the receptacle cage 110 for interfacing with a panel (not shown), such as when the front end 120 of the receptacle cage 110 extends through a cutout in the panel. The gaskets 142 may include spring fingers or other deflectable features that are configured to be spring biased against the panel to create an electrical connection with the panel.

Optionally, the receptacle connector assembly 104 may include one or more heat sinks (not shown) for dissipating heat from the pluggable modules 106. For example, the heat sink may be coupled to the top wall 130 for engaging the pluggable module 106 received in the module channel 116. The heat sink may extend through an opening in the top wall 130 to directly engage the pluggable module 106. Other types of heat sinks may be provided in alternative embodiments.

In an exemplary embodiment, the card edge connector 112 is received in the cavity 140, such as proximate to the rear wall 138. However, in alternative embodiments, the card edge connector 112 may be located behind the rear wall 138 exterior of the receptacle cage 110 and extend into the cavity 140 to interface with the pluggable module(s) 106. In an exemplary embodiment, a single card edge connector 112 is provided. In alternative embodiments, the communication system 100 may include multiple card edge connectors 112 (for example, for stacked and/or ganged receptacle cages) for mating with corresponding pluggable modules 106.

In an exemplary embodiment, the pluggable modules 106 are loaded through the port 118 at the front end 120 to mate with the card edge connector 112. The shielding walls 114 of the receptacle cage 110 provide electrical shielding around the card edge connector 112 and the pluggable module 106, such as around the mating interface between the card edge connector 112 and the pluggable module 106.

Figure 2:
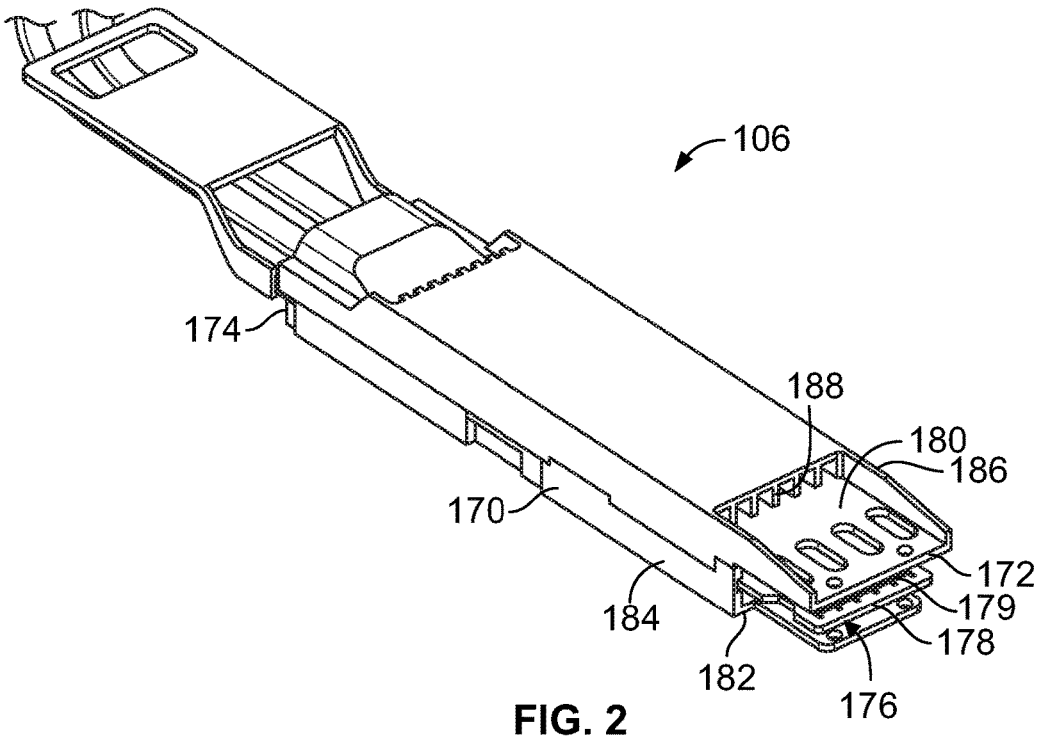
FIG. 2 is a rear perspective view of a pluggable module of the communication system in accordance with an exemplary embodiment.

FIG. 2 is a rear perspective view of the pluggable module 106 in accordance with an exemplary embodiment. The pluggable module 106 has a pluggable body 170, which may be defined by one or more shells. The pluggable body 170 may be thermally conductive and/or may be electrically conductive, such as to provide EMI shielding for the pluggable module 106. The pluggable body 170 includes a mating end 172 and an opposite front end 174. The mating end 172 is configured to be inserted into the corresponding module channel 116 (shown in FIG. 1). The front end 174 may be a cable end having a cable extending therefrom to another component within the system.

The pluggable module 106 includes a module circuit board 176 that is configured to be communicatively coupled to the card edge connector 112 (shown in FIG. 1). The module circuit board 176 may be accessible at the mating end 172. The module circuit board 176 has a card edge 178 extending between a first or upper surface and a second or lower surface at a mating end of the module circuit board 176. The module circuit board 176 includes mating contacts 179, such as pads or circuits, at the card edge 178 configured to be mated with the card edge connector 112. The module circuit board 176 may include components, circuits and the like used for operating and or using the pluggable module 106. For example, the module circuit board 176 may have conductors, traces, pads, electronics, sensors, controllers, switches, inputs, outputs, and the like associated with the module circuit board 176, which may be mounted to the module circuit board 176, to form various circuits.

The pluggable module 106 includes an outer perimeter defining an exterior of the pluggable body 170. For example, the outer perimeter may be defined by a top 180, a bottom 182, a first side 184 and a second side 186. The pluggable body 170 may have other shapes in alternative embodiments. In an exemplary embodiment, the pluggable body 170 provides heat transfer for the module circuit board 176, such as for the electronic components on the module circuit board 176. For example, the module circuit board 176 is in thermal communication with the pluggable body 170 and the pluggable body 170 transfers heat from the module circuit board 176. Optionally, the pluggable body 170 may include a plurality of heat transfer fins 188 along at least a portion of the outer perimeter, such as the top 180, of the pluggable module 106 for dissipating heat from the pluggable body 170.

Figure 3:
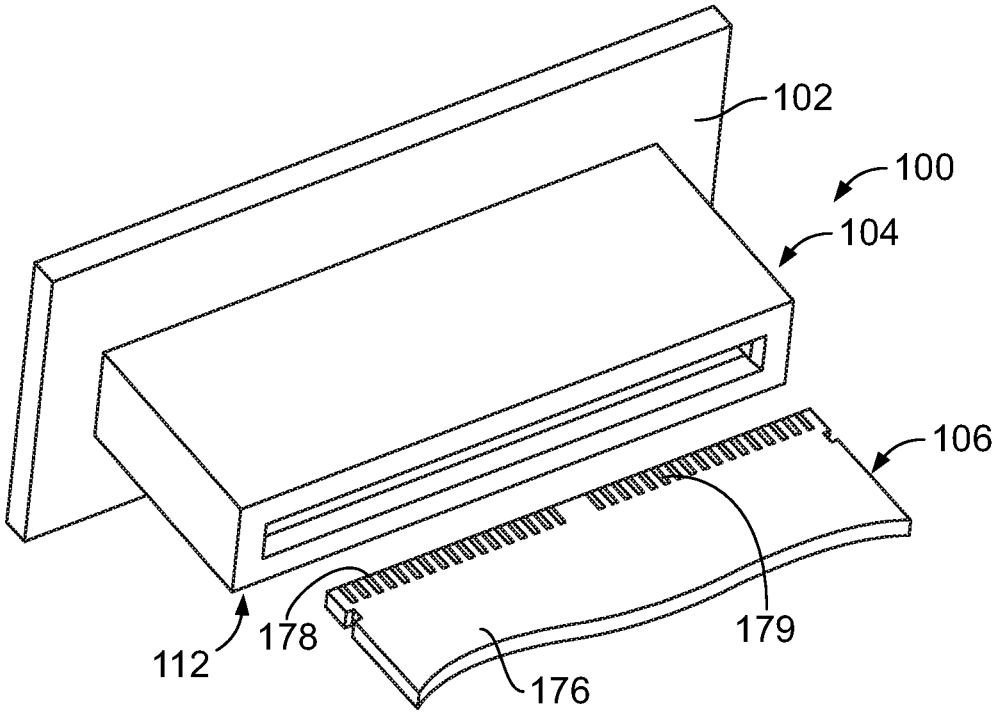
FIG. 3 is a front perspective view of the communication system in accordance with an exemplary embodiment.

FIG. 3 is a front perspective view of the communication system 100 in accordance with an exemplary embodiment. The receptacle connector assembly 104 is shown as a card edge connector 112 mounted to the circuit board 102 (without a receptacle cage). The card edge connector 112 may be mounted horizontally or vertically in various embodiments. The card edge connector 112 may be mounted to the circuit board 102 to receive the pluggable module in a direction perpendicular to the circuit board 102 in various embodiments. In alternative embodiments, the card edge connector 112 may be a right-angle card edge connector mounted to the circuit board 102 to receive the pluggable module 106 in a direction parallel to the circuit board 102. In the illustrated embodiment, the receptacle connector assembly 104 is a pass-through connector having the mating end and the mounting end of the housing parallel to each other rather than perpendicular to each other such that the contacts pass straight through the housing rather than being right angle contacts.

In the illustrated embodiment, the pluggable module 106 includes the module circuit board 176 without the outer pluggable body holding the module circuit board 176. The module circuit board 176 includes the card edge 178 between a first or upper surface and a second or lower surface at a mating end of the module circuit board 176. The module circuit board 176 includes the mating contacts 179 at the card edge 178, such as at both the upper surface and the lower surface, configured to be mated with the contacts of the card edge connector 112.

Figure 4:
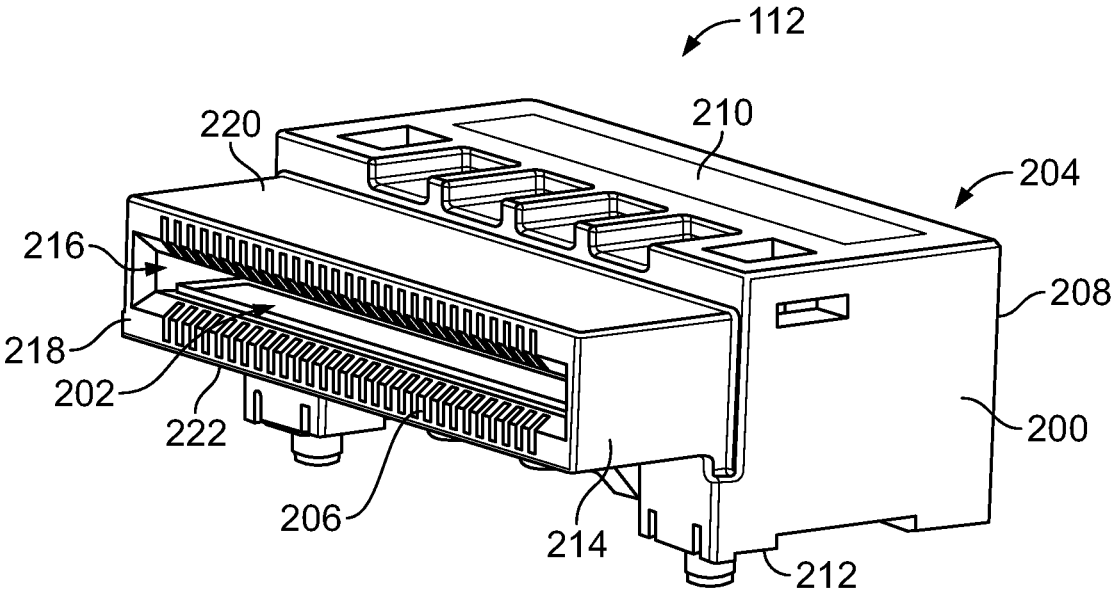
FIG. 4 is a front perspective view of a card edge connector of the communication system in accordance with an exemplary embodiment.

FIG. 4 is a front perspective view of the card edge connector 112 in accordance with an exemplary embodiment. The card edge connector 112 includes a housing 200 having a contact assembly 202 received in a cavity 204 of the housing 200. The housing 200 extends between a front 206 and a rear 208. The housing 200 extends between a top 210 and a bottom 212. In the illustrated embodiment, the bottom 212 defines a mounting end configured to be mounted to the host circuit board 102 (shown in FIG. 1) and the front 206 defines the mating end configured to be mated with the pluggable module 106 (shown in FIG. 1). Other orientations are possible in alternative embodiments.

The housing 200 includes a top wall 220 at the top 210 and a bottom wall 222 at the bottom 212. In the illustrated embodiment, the housing 200 includes a shroud 214 at the front 206 configured to be mated with the pluggable module 106. The shroud 214 includes a front face 218. The shroud 214 is configured to be received in the pluggable module 106. The housing 200 includes a housing card slot 216 at the front 206. For example, the housing card slot 216 may be located in the shroud 214 and open at the front face 218. The housing card slot 216 receives the card edge 178 (shown in FIG. 2) of the module circuit board 176 (shown in FIG. 2).

Figure 5:
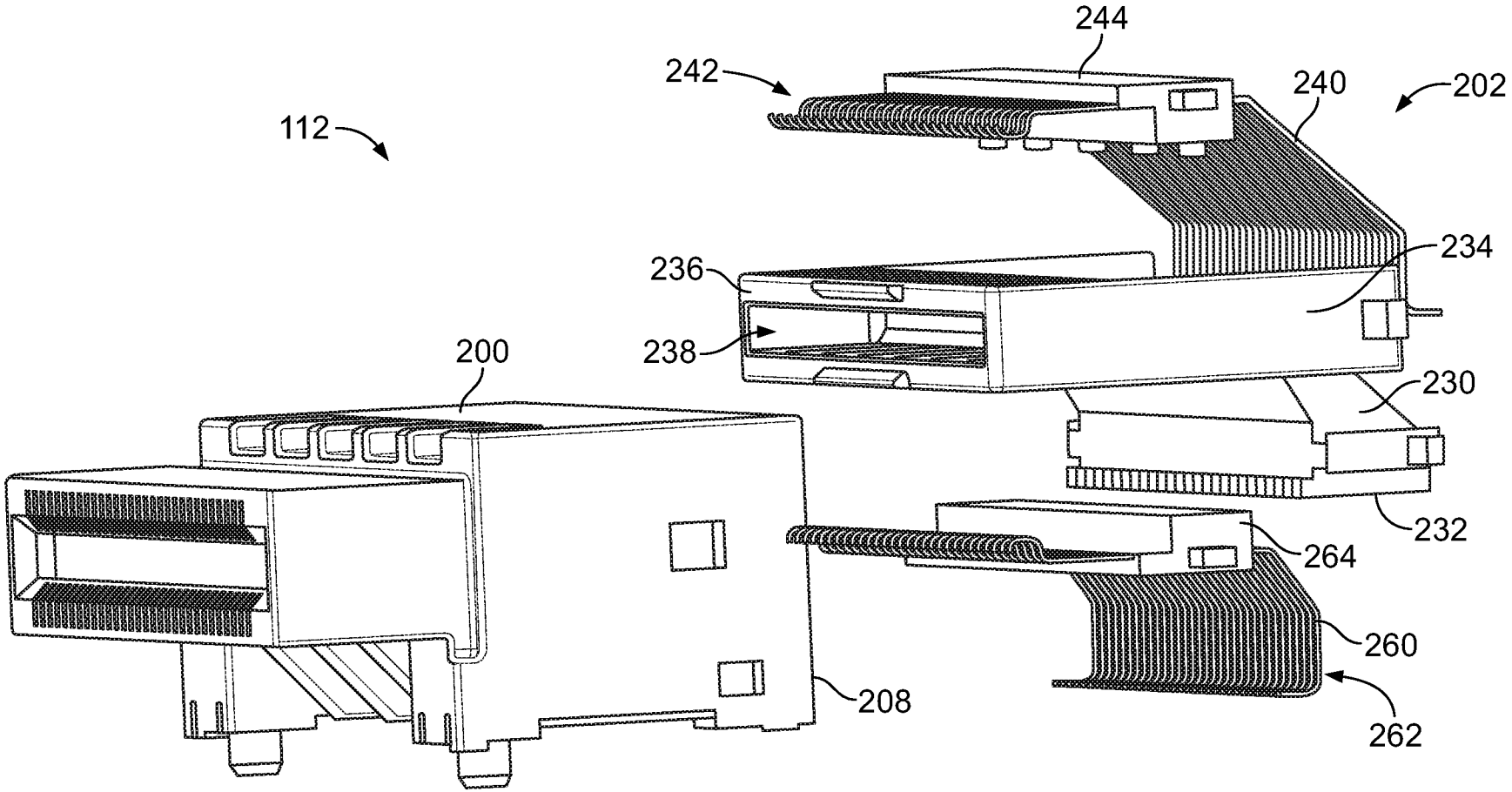
FIG. 5 is an exploded view of the card edge connector in accordance with an exemplary embodiment.

FIG. 5 is an exploded view of the card edge connector 112 in accordance with an exemplary embodiment. The contact assembly 202 includes a contact positioner 230, upper contacts 240 arranged in an upper contact array 242, and lower contacts 260 arranged in a lower contact array 262. The contact positioner 230 is used to position the upper and lower contacts 240, 260 relative to each other. The upper contacts 240 are held by an upper contact holder 244 and the lower contacts 260 are held by a lower contact holder 264. The contact holders 244, 264 are separate from each other and configured to be coupled to each other and/or to the contact positioner 230. The contact holders 244, 264 are coupled to the contact positioner 230 to load the upper and lower contacts 240, 260 in the contact positioner 230 to form the contact assembly 202. The assembled contact assembly 202 is configured to be loaded into the housing 200, such as through the rear 208 of the housing 200.

The contact positioner 230 includes a base 232, arms 234 extending from the base 232 and a nose 236 between the arms 234. The contact positioner 230 has a positioner card slot 238 in the nose 236. The positioner card slot 238 receives the card edge 178 of the module circuit board 176. The base 232 holds the upper and lower contacts 240, 260. The nose 236 holds the upper and lower contacts 240, 260. In an exemplary embodiment, the nose 236 of the contact positioner 230 is used to pre-load each of the upper and lower contacts 240, 260 with an internal spring biasing force for mating with the module circuit board 176. Pre-loading the upper and lower contacts 240, 260 causes the upper and lower contacts 240, 260 to be biased against the module circuit board 176 to ensure that the electrical connection between the upper and lower contacts 240, 260 and the module circuit board 176 is maintained. The upper and lower contacts 240, 260 are flexed outward by the module circuit board 176 when the module circuit board 176 is loaded in the positioner card slot 238. The internal biasing force, pre-loaded within the upper and lower contacts 240, 260, ensures that sufficient contact force is provided with small flexing of the upper and lower contacts 240, 260 by the module circuit board 176.

In various embodiments, the upper contact holder 244 is a dielectric body holding the upper contacts 240. For example, the upper contact holder 244 may be overmolded over the upper contact array 242. The upper contact array 242 may be a leadframe having stamped and formed contacts. In various embodiments, the lower contact holder 264 is a dielectric body holding the lower contacts 260. For example, the lower contact holder 264 may be overmolded over the upper contact array 262. The lower contact array 262 may be a leadframe having stamped and formed contacts. In other various embodiments, the upper contacts 240 may be paired with corresponding lower contacts 260 in corresponding wafers and overmolded by a corresponding wafer body defining a contact holder. The dielectric wafers may be stacked together in a wafer stack and loaded into the contact positioner 230.

Figure 6:
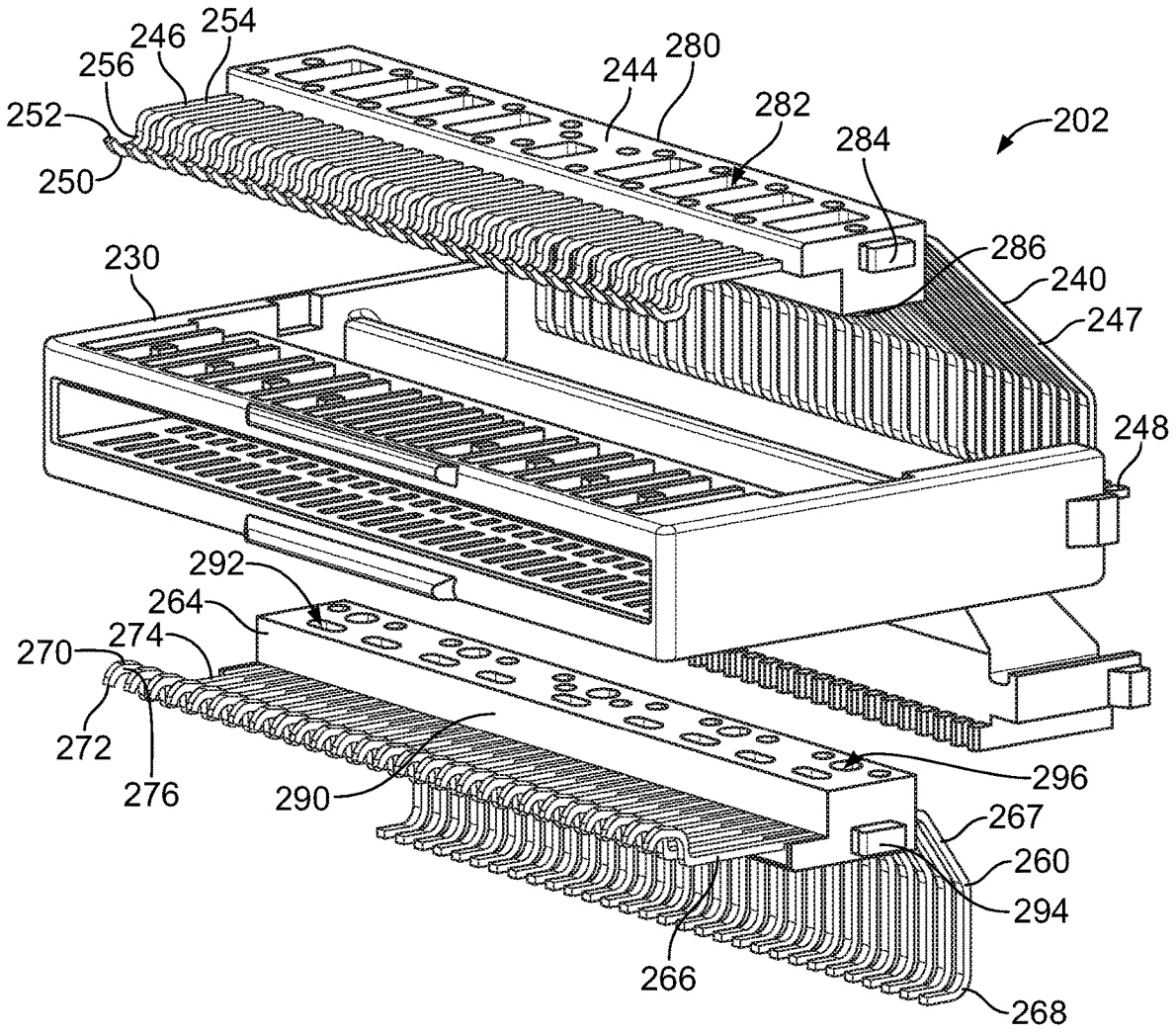
FIG. 6 is an exploded view of a contact assembly of the card edge connector in accordance with an exemplary embodiment.

FIG. 6 is an exploded view of the contact assembly 202 in accordance with an exemplary embodiment. During assembly, the contact holders 244, 264 hold the upper and lower contacts 240, 260 and are used to load the upper and lower contacts 240, 260 into the contact positioner 230. The upper and lower contacts 240, 260 are loaded into the base 232 and into the nose 236 to position the upper and lower contacts 240, 260 for mating with the module circuit board 176 (shown in FIG. 2) and for mounting to the host circuit board 102 (shown in FIG. 1).

Each upper contact 240 includes a transition portion 247 extending between a mating beam 246 at a mating end and a contact tail 248 at a terminating end. The transition portion 247 is held by the upper contact holder 244. The contact tail 248 is configured to be terminated to the host circuit board 102. The mating beam 246 is configured to extend into the shroud 214 for mating with the module circuit board 176. In an exemplary embodiment, the upper contacts 240 are stamped and formed contacts. Various upper contacts 240 may be signal contacts and other upper contacts 240 may be ground contacts, such as interspersed between signal contacts or pairs of signal contacts.

In an exemplary embodiment, the upper contacts 240 are flexible and configured to be elastically deformed and flexed during use, such as during mating with the module circuit board 176. For example, the mating beams 246 are defined by cantilevered spring beams extending forward from the upper contact holder 244. In an exemplary embodiment, the mating beam 246 includes a mating interface 250 at a tip 252 of the upper contact 240. For example, the spring beam defining the mating beam 246 includes an arm 254 and a finger 256 extending from the arm 254 to the tip 252. The arm 254 extends generally forwardly (for example, horizontally) and the finger 256 extends generally inward (for example, vertically) from the arm 254. The finger 256 may be curved and extend both inwardly from the arm 254 to the mating interface 250 and outwardly to the tip 252. The finger 256 may have a flat section between the curved sections to define the mating interface 250. In other various embodiments, the upper contact 240 may end at the mating interface 250 with the tip 252 at the mating interface 250 and does not create an electrical stub beyond the mating interface 250. For example, the upper contact 240 does not include a flared lead-in beyond the mating interface 250 as is common with conventional contacts.

Each lower contact 260 includes a transition portion 267 extending between a mating beam 266 at a mating end and a contact tail 268 at a terminating end. The transition portion 267 is held by the lower contact holder 264. The contact tail 268 is configured to be terminated to the host circuit board 102. The mating beam 266 is configured to extend into the shroud 214 for mating with the module circuit board 176. In an exemplary embodiment, the lower contacts 260 are stamped and formed contacts. Various lower contacts 260 may be signal contacts and other lower contacts 260 may be ground contacts, such as interspersed between signal contacts or pairs of signal contacts.

In an exemplary embodiment, the lower contacts 260 are flexible and configured to be elastically deformed and flexed during use, such as during mating with the module circuit board 176. For example, the mating beams 266 are defined by cantilevered spring beams extending forward from the lower contact holder 264. In an exemplary embodiment, the mating beam 266 includes a mating interface 270 at a tip 272 of the lower contact 260. For example, the spring beam defining the mating beam 266 includes an arm 274 and a finger 276 extending from the arm 274 to the tip 272. The arm 274 extends generally forwardly (for example, horizontally) and the finger 276 extends generally inward (for example, vertically) from the arm 274. The finger 276 may be curved and extend both inwardly from the arm 274 to the mating interface 270 and outwardly to the tip 272. The finger 276 may have a flat section between the curved sections to define the mating interface 270. In other various embodiments, the lower contact 260 may end at the mating interface 270 with the tip 272 at the mating interface 270 and does not create an electrical stub beyond the mating interface 270. For example, the lower contact 260 does not include a flared lead-in beyond the mating interface 270 as is common with conventional contacts.

In various embodiments, the upper contact holder 244 includes a dielectric frame 280 overmolded around the upper contacts 240 to encase the transition portions 247. The upper contact holder 244 includes impedance control air voids 282 in the dielectric frame 280 to control impedance of the corresponding signals contacts. In an exemplary embodiment, the upper contact holder 244 includes securing features 284 for securing the frame 280 to the contact positioner 230. In an exemplary embodiment, the upper contact holder 244 includes alignment features 286 for aligning the upper contact holder 244 to the lower contact holder 264 in the contact positioner 230. For example, the alignment features 286 may include alignment posts, alignment holes or other types of alignment features.

In various embodiments, the lower contact holder 264 includes a dielectric frame 290 overmolded around the lower contacts 260 to encase the transition portions 267. The lower contact holder 264 includes impedance control air voids 292 in the dielectric frame 290 to control impedance of the corresponding signals contacts. In an exemplary embodiment, the lower contact holder 264 includes securing features 294 for securing the frame 290 to the contact positioner 230. In an exemplary embodiment, the lower contact holder 264 includes alignment features 296 for aligning the lower contact holder 264 to the upper contact holder 244 in the contact positioner 230. For example, the alignment features 296 may include alignment posts, alignment holes or other types of alignment features.

The upper and lower contact holders 244, 264 are coupled to the contact positioner 230 to load the upper and lower contacts 240, 260 into the contact positioner 230. In the illustrated embodiment, the contact positioner 230 forms a right angle to transition the transition portions 247, 267 from the mating beams 246, 266 to the contact tails 248, 268. Other orientations are possible in alternative embodiments.

Figure 7:
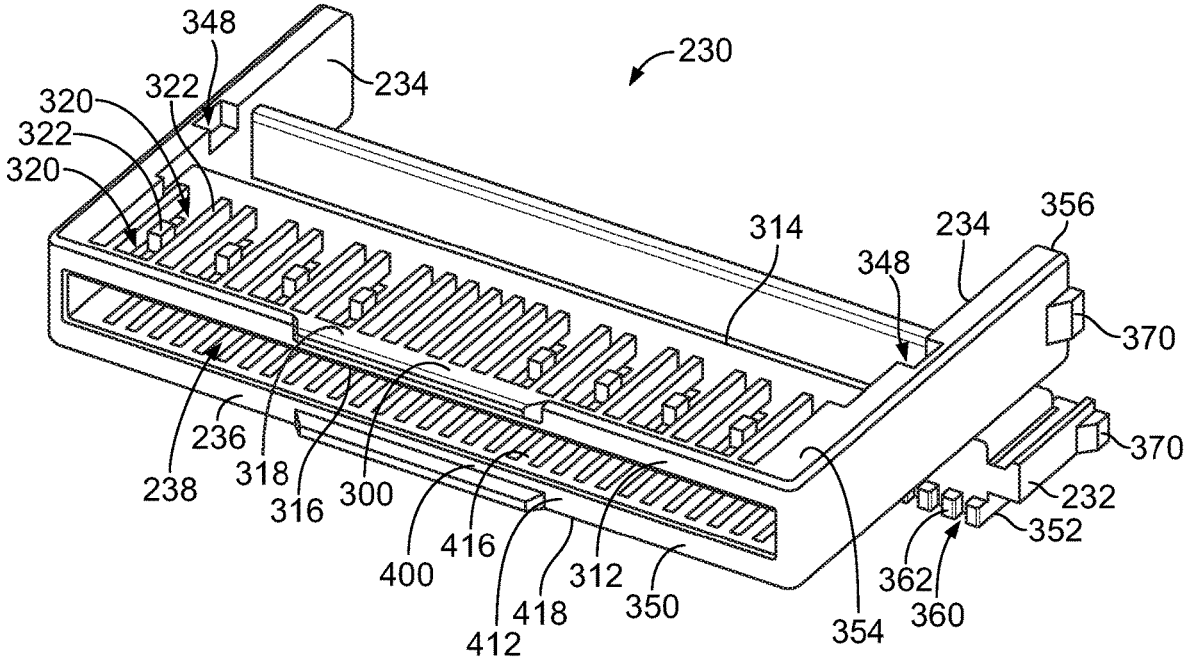
FIG. 7 is a front perspective view of a contact positioner of the contact assembly in accordance with an exemplary embodiment.
Figure 8:
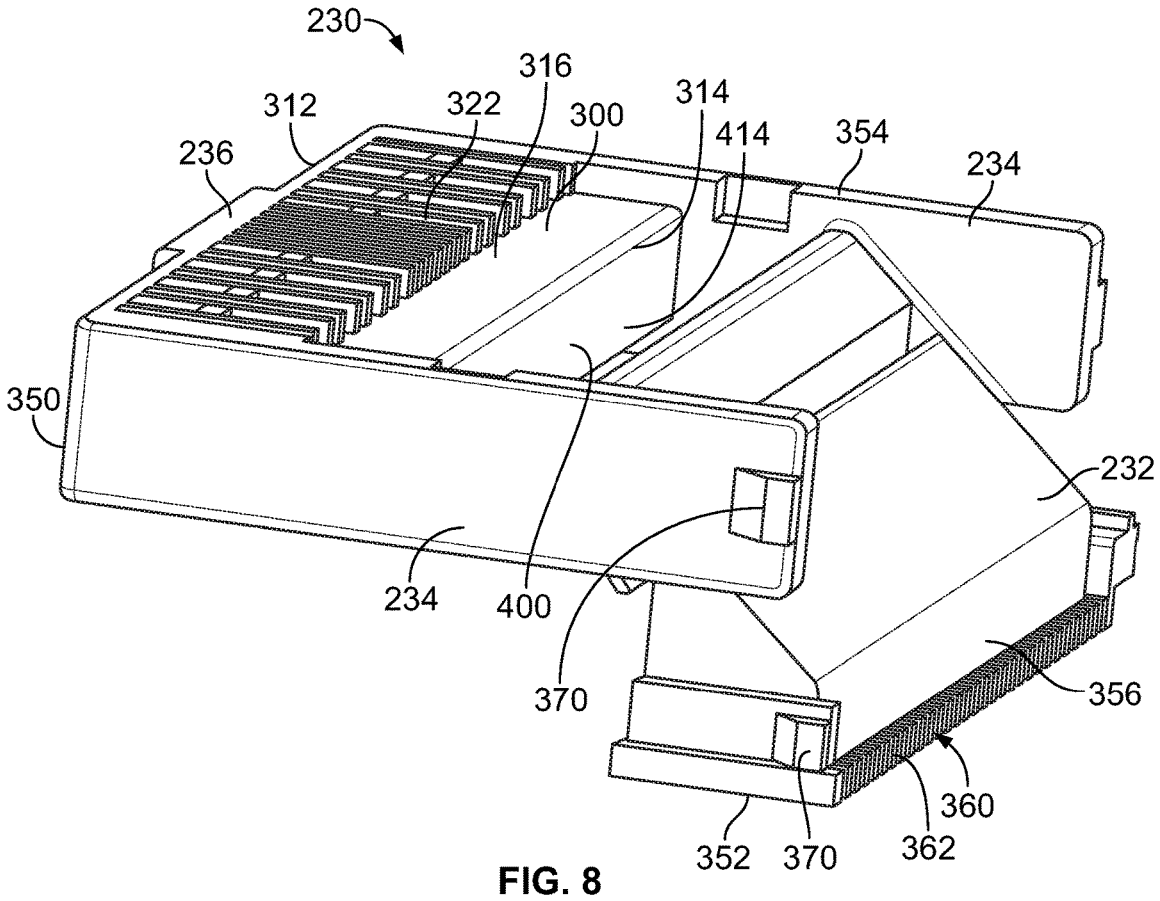
FIG. 8 is a rear perspective view of the contact positioner in accordance with an exemplary embodiment.

FIG. 7 is a front perspective view of the contact positioner 230 in accordance with an exemplary embodiment. FIG. 8 is a rear perspective view of the contact positioner 230 in accordance with an exemplary embodiment. The arms 234 extend forward from the base 232 to support the nose 236. The arms 234 or the base 232 may include pockets 348 that receive the securing features 284, 294 (shown in FIG. 6) of the upper and lower contact holders 244, 264 (shown in FIG. 6).

In an exemplary embodiment, the contact positioner 230 is a right-angle contact positioner having a mating end at a front wall 350 of the contact positioner 230 and a mounting end at a bottom 352 of the contact positioner 230. The base 232 is provided at the bottom 352. The nose 236 extends to the front wall 350. Other orientations are possible in alternative embodiments, such as with the nose 236 at a top 354 of the contact positioner 230 and/or the base 232 at a rear 356 of the contact positioner 230.

The base 232 is configured to be mounted to the host circuit board 102 (shown in FIG. 1). In an exemplary embodiment, the base 232 includes tail channels 360 that receive the contact tails 248, 268. The tail channels 360 are provided at a front of the base 232 to receive the contact tails 268 of the lower contacts 260. The tail channels 360 are provided at a rear of the base 232 to receive the contact tails 248 of the upper contacts 240. Separating walls 362 are provided between the tail channels 360. The separating walls 362 and the tail channels 360 organize the contact tails 248, 268 for mounting to the host circuit board 102. For example, the contact tails 248, 268 are held at a predetermined pitch within the corresponding tail channels 360.

In an exemplary embodiment, the contact positioner 230 includes securing features 370 for securing the contact positioner 230 in the housing 200. The securing features 370 may be latches or other types of securing features. The securing features 370 may be provided on the arms 234 and/or the base 232 and/or the nose 236.

The nose 236 includes an upper wall 300 and a lower wall 400. The upper wall 300 receives and supports the mating beams 246 of the upper contacts 240. The lower wall 400 receives and supports the mating beams 266 of the lower contacts 260.

The upper wall 300 extends between a front 312 and a rear 314. The upper wall 300 includes an inner end 316 (for example, bottom) and an outer end 318 (for example, top). The inner end 316 faces the positioner card slot 238. The outer end 318 is configured to face the housing 200 (shown in FIG. 4) when received in the cavity 204 (shown in FIG. 4).

The upper wall 300 includes impedance control air voids 320 therein, such as in the outer end 318 of the upper wall 300. The impedance control air voids 320 are sized and shaped to increase the volume of air around corresponding upper contacts 240, such as signal contacts for impedance control. The upper wall 300 may include separating walls 322 configured to separate corresponding upper contacts 240. The impedance control air voids 320 may pass through corresponding separating walls 322. For example, some separating walls 322 may be shorter than other separating walls 322 to form the impedance control air voids 320.

The lower wall 400 extends between a front 412 and a rear 414. The lower wall 400 includes an inner end 416 (for example, top) and an outer end 418 (for example, bottom). The inner end 416 faces the positioner card slot 238. The outer end 418 is configured to face the housing 200 when received in the cavity 204.

Figure 9:
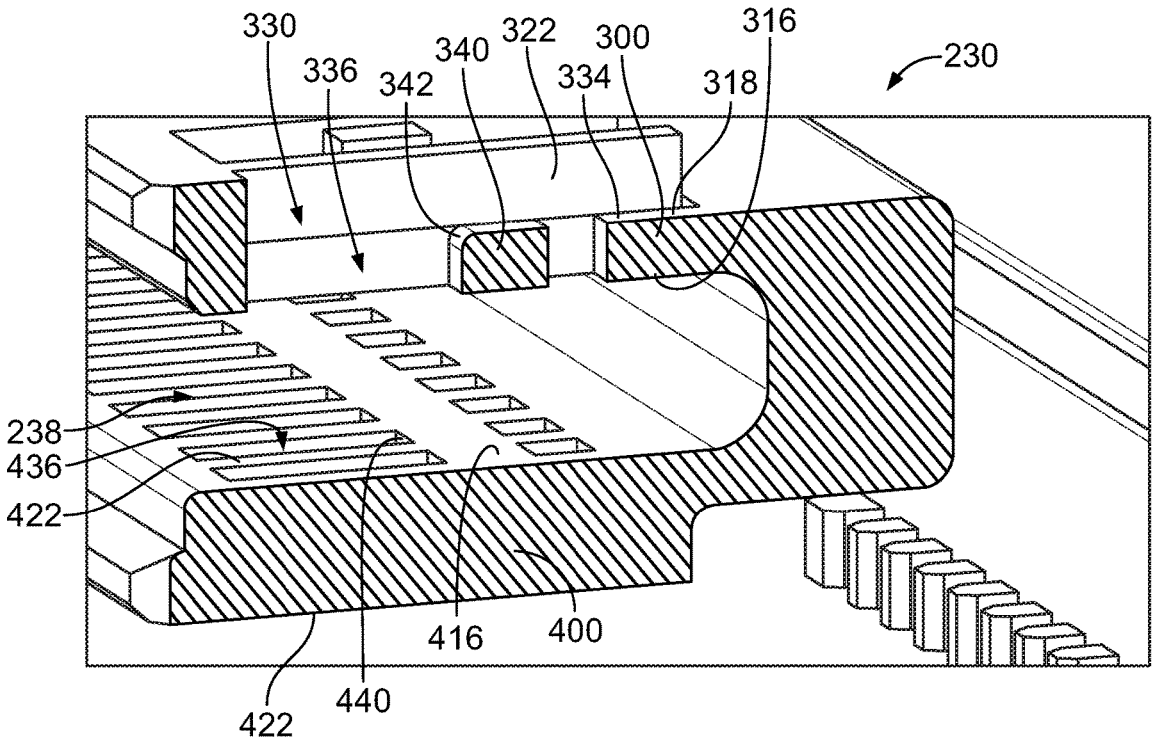
FIG. 9 is a sectional view of a portion of the contact positioner in accordance with an exemplary embodiment.

FIG. 9 is a sectional view of a portion of the contact positioner 230 in accordance with an exemplary embodiment. FIG. 9 illustrates the positioner card slot 238 between the upper wall 300 and the lower wall 400. The inner ends 316, 416 face each other on opposite ends of the positioner card slot 238. The inner ends 316, 416 defined the positioner card slot 238.

In an exemplary embodiment, the upper wall 300 includes contact channels 330 receiving the mating beams 246 of the upper contacts 240. The contact channels 330 are defined by the separating walls 322 and end walls 334. In the illustrated embodiment, the end walls 334 are located at bottoms of the contact channels 330. Optionally, the contact channels 330 may be open along the outer end 318 to receive the upper contacts 240 and/or to expose the upper contacts 240 to air.

The upper wall 300 includes contacts slots 336 at the inner end 316 open to the contact channels 330. The contacts slots 336 are configured to receive portions of the upper contacts 240. For example, the arm 254 (shown in FIG. 6) may extend through the contact channel 330 and the finger 256 (shown in FIG. 6) may extend into the contact slot 336.

In an exemplary embodiment, the upper wall 300 includes pre-load beams 340 in the contact channels 330 and/or the contacts slots 336. The pre-load beams 340 are positioned to interact with the upper contacts 240 to pre-load the upper contacts 240 and impart an internal spring biasing force within the upper contacts 240. The pre-load beams 340 may extend between corresponding separating walls 322. In the illustrated embodiment, the pre-load beams 340 are located in the contact slots 336. The pre-load beams 340 include edges 342 defined at the corner between the contact channels 330 and the contact slots 336.

In an exemplary embodiment, the lower wall 400 is similar to the upper wall 300 having a reverse orientation within the housing 200. However, the lower wall 400 may include different features than the upper wall 300 in various embodiments.

In an exemplary embodiment, the lower wall 400 includes contact channels 430 (shown in FIG. 12) receiving the lower contacts 260 (shown in FIG. 6). The contact channels 430 are defined by separating walls 422 and end walls 434. The lower wall 400 includes contacts slots 436 open to the contact channels 430. The contacts slots 436 receive portions of the lower contacts 260. In an exemplary embodiment, the lower wall 400 includes pre-load beams 440 in the contact channels 430 and/or the contacts slots 436. The pre-load beams have edges 442 (shown in FIG. 12) defined at the corner between the contact channels 430 and the contacts slots 436.

Figure 10:
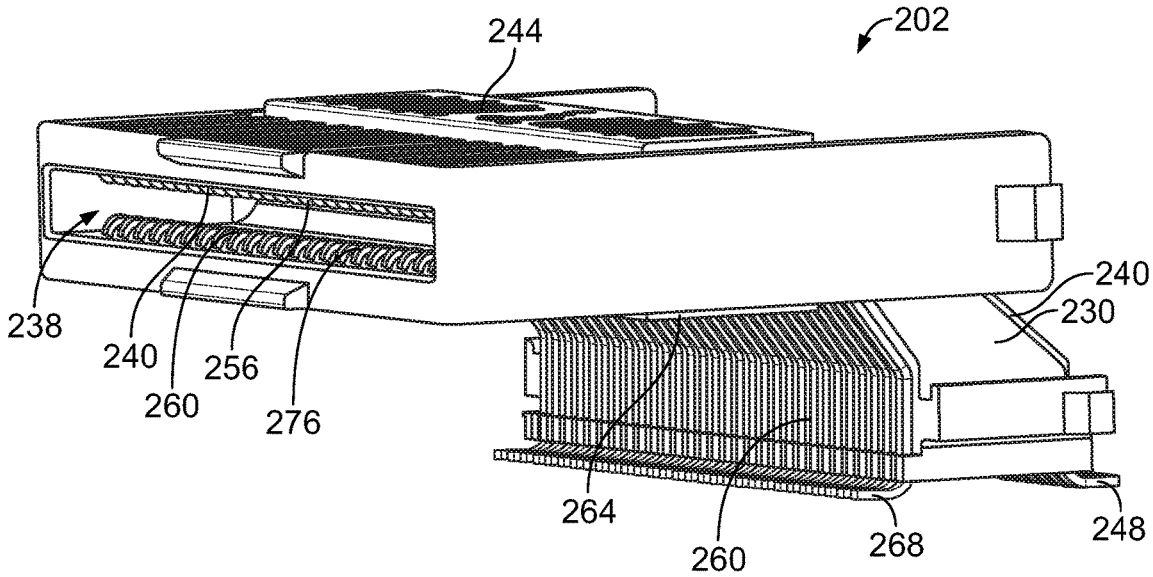
FIG. 10 is a front perspective view of the contact assembly in accordance with an exemplary embodiment.

FIG. 10 is a front perspective view of the contact assembly 202. The upper and lower contact holders 244, 264 are coupled to the contact positioner 230. The contact positioner 230 positions and holds the contact tails 248, 268 of the upper and lower contacts 240, 260. The contact positioner 230 positions and holds the mating beams 246, 266 of the upper and lower contacts 240, 260. In an exemplary embodiment, the fingers 256, 276 of the upper and lower contacts 240, 260 extend into the positioner card slot 238 for mating engagement with the module circuit board 176 (shown in FIG. 2).

Figure 11:
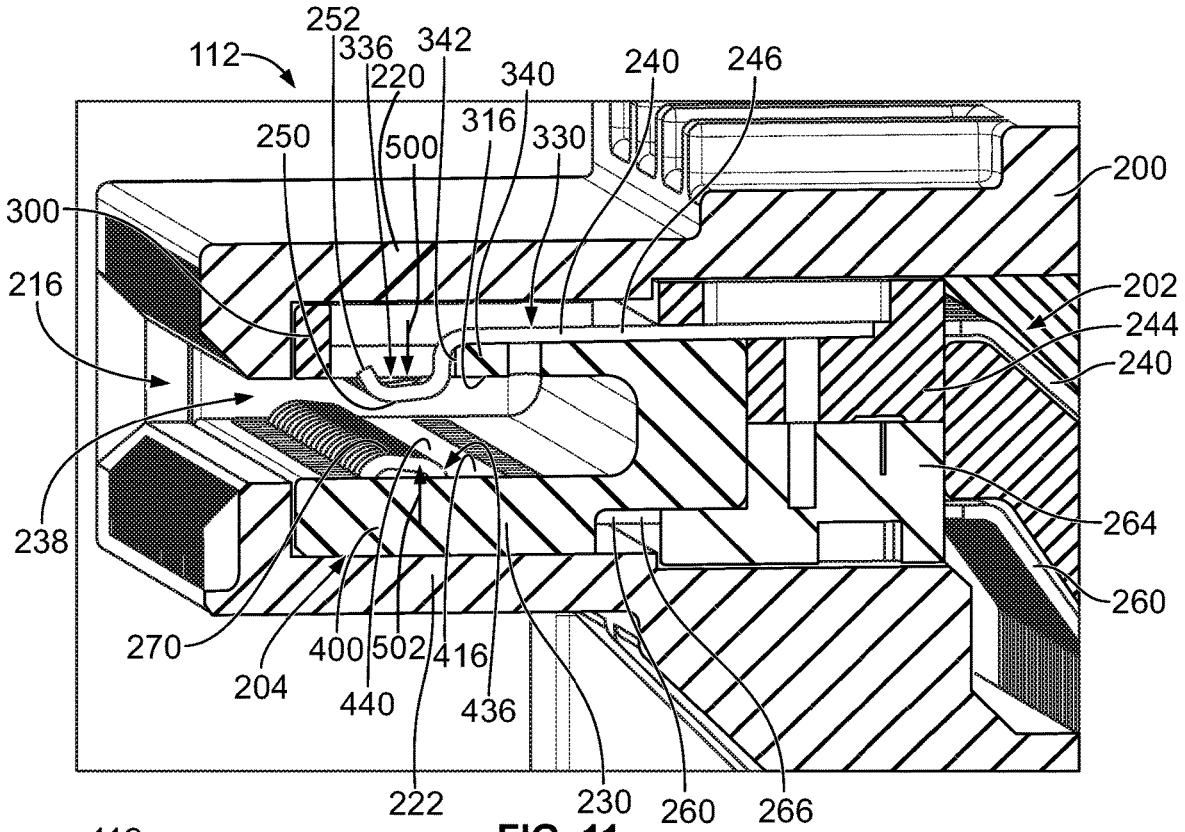
FIG. 11 is a sectional view of a portion of the card edge connector showing the contact assembly received in a housing in accordance with an exemplary embodiment.

FIG. 11 is a sectional view of a portion of the card edge connector 112 showing the contact assembly 202 received in the cavity 204 of the housing 200. The upper wall 300 of the contact positioner 230 extends along the top wall 220 of the housing 200 and the lower wall 400 of the contact positioner 230 extends along the bottom wall 222. The positioner card slot 238 is aligned with the housing card slot 216 to receive the module circuit board 176 (shown in FIG. 2).

The mating beam 246 of the upper contact 240 extends forward from the upper contact holder 244 into the corresponding contact channel 330. The mating beam 246 engages the pre-load beam 340. The pre-load beam 340 positions the mating beam 246 (for example, positions the mating beam 246 further outward than a normal resting position, creating an internal spring force within the upper contact 240). In an exemplary embodiment, the mating beam 246 is flexed against the pre-load beam 340 when assembled. For example, the mating beam 246 is flexed to pre-load the upper contact 240 in an inward biasing direction 500 (for example, toward the module circuit board 176). In the illustrated embodiment, the inward biasing direction is a downward direction; however, other orientations are possible in alternative embodiments. The mating beam 246 is spring biased against the upper wall 300 and presses inward at the edge 342. The mating beam 246 rests on the edge 342 and extends through the contact slot 336 such that the mating interface 250 is in the positioner card slot 238 to interface with the module circuit board 176. The mating interface 250 is located inward of the inner end 316 of the upper wall 300. In an exemplary embodiment, the tip 252 extends into the upper wall 300 and is protected from stubbing on the module circuit board 176 when the module circuit board 176 is loaded into the positioner card slot 238. For example, the tip 252 extends into the contact slot 336.

The mating beam 266 of the lower contact 260 extends forward from the lower contact holder 264 into the corresponding contact channel 430. The mating beam 266 engages the pre-load beam 440. In an exemplary embodiment, the mating beam 266 is flexed against the pre-load beam 440 when assembled. For example, the mating beam 266 is flexed to pre-load the lower contact 260 in an inward biasing direction 502 (for example, toward the module circuit board 176). In the illustrated embodiment, the inward biasing direction is an upward direction; however, other orientations are possible in alternative embodiments. The mating beam 266 extends through the contact slot 436 such that the mating interface 270 is in the positioner card slot 238 to interface with the module circuit board 176. The mating interface 270 is located inward of the inner end 416 of the lower wall 400. In an exemplary embodiment, the tip 272 extends into the lower wall 400 and is protected from stubbing on the module circuit board 176 when the module circuit board 176 is loaded into the positioner card slot 238. For example, the tip 272 extends into the contact slot 436.

Pre-loading the upper and lower contacts 240, 260 ensures that an internal biasing force is pre-loaded into the upper and lower contacts 240, 260 prior to mating with the module circuit board 176. The pre-load force reduces the amount of deflection of the upper and lower contacts 240, 260 needed to achieve sufficient internal biasing force to maintain the electrical connection between the upper and lower contacts 240, 260 and the module circuit board 176. As such, the length of the tips 252, 272 may be reduced, leading to a reduction in electrical stub of the upper and lower contacts 240, 260.

Figure 12:
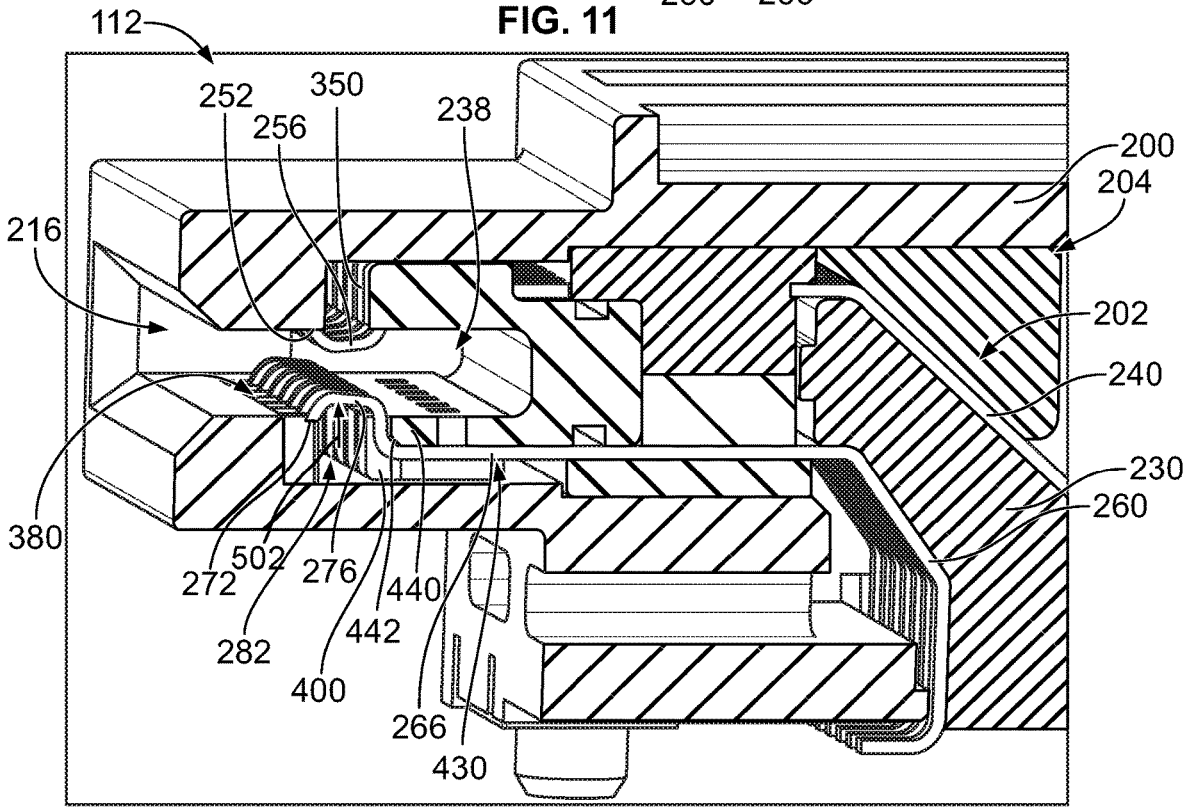
FIG. 12 is a sectional view of a portion of the card edge connector showing the contact assembly received in the housing in accordance with an exemplary embodiment.

FIG. 12 is a sectional view of a portion of the card edge connector 112 showing the contact assembly 202 received in the cavity 204 of the housing 200. In the illustrated embodiment, the contact positioner 230 is shortened compared to the embodiment illustrated in FIG. 11. The upper and lower contacts 240, 260 extend forward of the front wall 350 of the contact positioner 230. The tips 252, 272 extend into contact channels 380 in the housing 200 and are protected from stubbing against the module circuit board 176 when the module circuit board 176 is loaded into the housing card slot 216 and the positioner card slot 238. An impedance control air void 282 is defined between the front wall 350 of the contact positioner 230 and the housing 200. The fingers 256, 276 of the upper and lower contacts 240, 260 extend into the impedance control air void 282. FIG. 12 illustrates the mating beam 266 of the lower contact 260 engaging the pre-load beam 440 of the lower wall 400. The pre-load beam 440 flexes the mating beam 266 to pre-load the lower contact 260 in the inward biasing direction 502. The pre-load beam 440 positions the mating beam 266 further outward than a normal resting position creating an internal spring force within the lower contact 260.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A card edge connector for mating with a pluggable module comprising:

an insulative housing having a cavity, a housing card slot at a front of the housing and a chamber adjacent the housing card slot, the housing card slot configured to receive a card edge of a module circuit board of the pluggable module; and a contact assembly received in the cavity, the contact assembly having a contact positioner holding upper contacts in an upper contact array and lower contacts in a lower contact array, the contact positioner having an upper wall with upper contact channels holding mating beams of the upper contacts, the contact positioner having a lower wall with lower contact channels holding mating beams of the lower contacts, the upper wall being positioned relative to the lower wall with a positioner card slot defined therebetween configured to receive the card edge of the module circuit board, the mating beams of the upper contacts extending into the positioner card slot to mate with the module circuit board and the mating beams of the lower contacts extending into the positioner card slot to mate with the module circuit board, the upper wall having pre-load beams in the upper contact channels engaging the mating beams of the upper contacts to pre-load the upper contacts in an inward biasing direction, the lower wall having pre-load beams in the lower contact channels engaging the mating beams of the lower contacts to pre-load the lower contacts in an inward biasing direction.

2. The card edge connector of claim 1, wherein the upper wall and the lower wall are fixed relative to each other on opposite sides of the positioner card slot, the mating beams of the upper and lower contacts being moved away from each other when mated with the module circuit board.

3. The card edge connector of claim 1, wherein the contact assembly includes an upper contact holder holding the upper contacts of the upper contact array with the mating beams thereof extending forward of the upper contact holder, the upper contact holder being coupled to the contact positioner, the contact assembly including a lower contact holder holding the lower contacts of the lower contact array with the mating beams thereof extending forward of the lower contact holder, the lower contact holder being coupled to the contact positioner.

4. The card edge connector of claim 3, wherein the mating beams of the upper contacts are flexed against the pre-load beams of the upper wall when the upper contact holder is coupled to the contact positioner and wherein the mating beams of the lower contacts are flexed against the pre-load beams of the lower wall when the lower contact holder is coupled to the contact positioner.

5. The card edge connector of claim 1, wherein the upper wall includes impedance control air voids between mating beams of the upper contacts and the lower wall includes impedance control air voids between mating beams of the lower contacts.

6. The card edge connector of claim 1, wherein the mating beams extend forward of a front wall of the contact positioner into housing contact channels of the housing.

7. The card edge connector of claim 1, wherein the contact positioner includes a base, arms extending from the base, and a nose between the arms, the base having tail channels receiving contact tails of the upper and lower contacts to position the contact tails relative to each other, the nose including the upper wall and the lower wall with extending between the arms, the nose having the positioner card slot between the upper and lower walls.

8. The card edge connector of claim 1, wherein the mating beams of the upper contacts are moved outward relative to the positioner card slot by the module circuit board from pre-loaded positions to released positions when the module circuit board is loaded into the positioner card slot and wherein the mating beams of the lower contacts are moved outward relative to the positioner card slot by the module circuit board from pre-loaded positions to released positions when the module circuit board is loaded into the positioner card slot.

9. The card edge connector of claim 8, wherein the mating beams of the upper contacts engage the pre-load beams of the upper wall in the pre-loaded positions and the mating beams of the upper contacts are free of and released from the pre-load beams in the released positions, and wherein the mating beams of the lower contacts engage the pre-load beams of the lower wall in the pre-loaded positions and the mating beams of the lower contacts are free of and released from the pre-load beams in the released positions.

10. The card edge connector of claim 1, wherein the mating beam of each upper contact includes an arm and a finger extending from the arm to a tip, the finger having a mating interface being located in the positioner card slot below the upper wall to engage the module circuit board, the tip being located in the upper wall, and wherein the mating beam of each lower contact includes an arm and a finger extending from the arm to a tip, the finger having a mating interface being located in the positioner card slot above the lower wall to engage the module circuit board, the tip being located in the lower wall.

11. The card edge connector of claim 1, wherein the contact positioner includes upper contact slots at an inner end of the upper wall open to corresponding upper contact channels, the mating beams of the upper contacts passing through corresponding contact slots into the positioner card slot to engage the module circuit card, and wherein the contact positioner includes lower contact slots at an inner end of the lower wall open to corresponding lower contact channels, the mating beams of the upper contacts passing through corresponding contact slots into the positioner card slot to engage the module circuit card.

12. The card edge connector of claim 11, wherein the pre-load beams of the upper wall are located at intersections between the upper contact slots and the upper contact channels, the mating beams of the upper contacts engaging the corresponding pre-load beams to pre-load the mating beams of the upper contacts with an internal pre-load force, and wherein the pre-load beams of the lower wall are located at intersections between the lower contact slots and the lower contact channels, the mating beams of the lower contacts engaging the corresponding pre-load beams to pre-load the mating beams of the lower contacts with an internal pre-load force.

13. A card edge connector for mating with a pluggable module comprising:

an insulative housing having a cavity, a housing card slot at a front of the housing and a chamber adjacent the housing card slot, the housing card slot configured to receive a card edge of a module circuit board of the pluggable module, the housing configured to be mounted to a host circuit board; and a contact assembly received in the cavity, the contact assembly comprising:

upper contacts in an upper contact array, the upper contacts having mating beams and contact tails at opposite ends of the upper contacts, the mating beams configured to be mated with the module circuit board, the contact tails configured to be terminated to the host circuit board;

lower contacts in a lower contact array, the lower contacts having mating beams and contact tails at opposite ends of the lower contacts, the mating beams configured to be mated with the module circuit board, the contact tails configured to be terminated to the host circuit board; and a contact positioner holding the upper and lower contacts, the contact positioner having a base, arms extending from the base and a nose between the arms, the base having tail channels receiving corresponding contact tails of the upper and lower contacts to position the contact tails relative to each other, the nose having an upper wall with upper contact channels holding corresponding mating beams of the upper contacts and a lower wall with lower contact channels holding corresponding mating beams of the lower contacts, the upper wall extending between the arms, the lower wall extending between the arms, the nose having a positioner card slot defined between the upper and lower walls configured to receive the card edge of the module circuit board, the upper wall having pre-load beams in the upper contact channels engaging the mating beams of the upper contacts to pre-load the upper contacts in a inward biasing direction, the lower wall having pre-load beams in the lower contact channels engaging the mating beams of the lower contacts to pre-load the lower contacts in an inward biasing direction.

14. The card edge connector of claim 13, wherein the upper wall and the lower wall are fixed relative to each other on opposite sides of the positioner card slot, the mating beams of the upper and lower contacts being moved away from each other when mated with the module circuit board.

15. The card edge connector of claim 13, wherein the contact assembly includes an upper contact holder holding the upper contacts of the upper contact array with the mating beams thereof extending forward of the upper contact holder, the upper contact holder being coupled to the contact positioner, the contact assembly including a lower contact holder holding the lower contacts of the lower contact array with the mating beams thereof extending forward of the lower contact holder, the lower contact holder being coupled to the contact positioner.

16. The card edge connector of claim 15, wherein the mating beams of the upper contacts are flexed against the pre-load beams of the upper wall when the upper contact holder is coupled to the contact positioner and wherein the mating beams of the lower contacts are flexed against the pre-load beams of the lower wall when the lower contact holder is coupled to the contact positioner.

17. The card edge connector of claim 13, wherein the mating beams of the upper contacts are moved outward relative to the positioner card slot by the module circuit board from pre-loaded positions to released positions when the module circuit board is loaded into the positioner card slot and wherein the mating beams of the lower contacts are moved outward relative to the positioner card slot by the module circuit board from pre-loaded positions to released positions when the module circuit board is loaded into the positioner card slot.

18. A card edge connector for mating with a pluggable module comprising:

an insulative housing having a cavity, a housing card slot at a front of the housing and a chamber adjacent the housing card slot, the housing card slot configured to receive a card edge of a module circuit board of the pluggable module; and a contact assembly received in the cavity, the contact assembly having a contact positioner holding upper contacts in an upper contact array and lower contacts in a lower contact array, the contact positioner having an upper wall with upper contact channels holding mating beams of the upper contacts, the contact positioner having a lower wall with lower contact channels holding mating beams of the lower contacts, the upper wall having an upper wall surface and the lower wall having a lower wall surface facing the upper wall surface across a positioner card slot configured to receive the card edge of the module circuit board, the mating beams of the upper contacts each having a arm and a finger at a distal end of the arm extending to a tip, the finger being arranged in the positioner card slot for mating engagement with the module circuit board, the tip being located above the upper wall surface, the mating beams of the lower contacts each having a arm and a finger at a distal end of the arm extending to a tip, the finger being arranged in the positioner card slot for mating engagement with the module circuit board, the tip being located below the lower wall surface, the upper wall having pre-load beams in the upper contact channels engaging the mating beams of the upper contacts to pre-load the upper contacts in an inward biasing direction, the lower wall having pre-load beams in the lower contact channels engaging the mating beams of the lower contacts to pre-load the lower contacts in an inward biasing direction.

19. The card edge connector of claim 18, wherein the upper wall and the lower wall are fixed relative to each other on opposite sides of the positioner card slot, the mating beams of the upper and lower contacts being moved away from each other when mated with the module circuit board.

20. The card edge connector of claim 18, wherein the contact positioner includes a base, arms extending from the base, and a nose between the arms, the base having tail channels receiving contact tails of the upper and lower contacts to position the contact tails relative to each other, the nose including the upper wall and the lower wall with extending between the arms, the nose having the positioner card slot between the upper and lower walls.

* * * * *